US009738499B2

(12) United States Patent
Plamondon et al.

(10) Patent No.: US 9,738,499 B2
(45) Date of Patent: Aug. 22, 2017

(54) LIFT ASSEMBLY HAVING A SPLIT TROLLEY

(75) Inventors: Noel Gabriel Plamondon, Brunswick, GA (US); William R. Johanek, Saint Simons Island, GA (US)

(73) Assignee: PAR SYSTEMS, INC., Shoreview, MN (US)

( * ) Notice: Subject to any disclaimer, the term of this patent is extended or adjusted under 35 U.S.C. 154(b) by 0 days.

(21) Appl. No.: 13/458,600

(22) Filed: Apr. 27, 2012

(65) Prior Publication Data

US 2012/0298936 A1 Nov. 29, 2012

Related U.S. Application Data

(60) Provisional application No. 61/479,679, filed on Apr. 27, 2011.

(51) Int. Cl.

| | |
|---|---|
| ***B66F 7/02*** | (2006.01) |
| ***B63B 27/16*** | (2006.01) |
| ***B63G 11/00*** | (2006.01) |

(52) U.S. Cl.

CPC ..... *B66F 7/02* (2013.01); *B63B 27/16* (2013.01); *B63G 11/00* (2013.01)

(58) Field of Classification Search

USPC ..... 254/264, 334, 338; 212/76, 77, 83, 97, 212/98, 328, 330; 114/48, 268; 187/250, 187/254, 256, 264

See application file for complete search history.

(56) References Cited

U.S. PATENT DOCUMENTS

| | | | | |
|---|---|---|---|---|
| 3,985,207 | A | 10/1976 | Petit | |
| 4,300,659 | A | 11/1981 | Silverstrand | |
| 4,329,082 | A | 5/1982 | Gillis | |
| 4,850,782 | A * | 7/1989 | Focke | B65G 61/00 187/405 |

(Continued)

FOREIGN PATENT DOCUMENTS

| | | | |
|---|---|---|---|
| DE | 202007018036 | U1 | 12/2007 |
| EP | 1717171 | A2 | 11/2006 |

(Continued)

OTHER PUBLICATIONS

Official Search Report of the European Patent Office in foreign application No. PCT/US2010/024883 filed Feb. 22, 2010.

(Continued)

*Primary Examiner* — Sang Kim
*Assistant Examiner* — Nathaniel Adams
(74) *Attorney, Agent, or Firm* — Steven M. Koehler; Westman, Champlin & Koehler, P.A.

(57) ABSTRACT

A trolley for a lift assembly is disclosed. The trolley includes a drive portion and a lift portion separable from the drive portion. The lift portion includes one or more fittings configured to hold one or more wire ropes for raising and lower a platform hitched to the wire ropes. The drive portion is connectable to a drive assembly to move the drive portion and lift portion along a lift stroke. Pairs of trolleys are interconnected via tension lines or wires connected to the lift portions of the trolleys. The lift portions are configured to move independent of the drive portions through lift provided via the interconnection of the lift portions through the tension lines or wires.

19 Claims, 9 Drawing Sheets

(56) References Cited

U.S. PATENT DOCUMENTS

| | | | | |
|---|---|---|---|---|
| 5,988,941 | A | 11/1999 | Sargent et al. | |
| 6,935,807 | B2 | 8/2005 | Becker | |
| 7,117,805 | B2 | 10/2006 | Shackelford, Jr. | |
| 7,413,378 | B2 | 8/2008 | Way | |
| 7,517,183 | B2 * | 4/2009 | Waisanen | 414/386 |
| 8,316,786 | B2 * | 11/2012 | Johanek et al. | 114/268 |
| 2010/0212569 | A1 | 8/2010 | Johanek et al. | |

FOREIGN PATENT DOCUMENTS

| | | | |
|---|---|---|---|
| GB | 1107250 | A | 3/1968 |
| WO | WO 2005120895 | | 12/2005 |

OTHER PUBLICATIONS

Written Opinion of the European Patent Office in foreign application No. PCT/US2010/024883 filed Feb. 22, 2010.

* cited by examiner

LIFT ASSEMBLY HAVING A SPLIT TROLLEY

CROSS-REFERENCE TO RELATED APPLICATION

The present application is based on and claims priority to U.S. provisional patent application Ser. No. 61/479,679 filed Apr. 27, 2011, the content of which is hereby incorporated by reference in its entirety.

BACKGROUND

Elevator platforms are found on ships, such as aircraft carriers to transfer heavy loads between decks of the ship. A lift assembly located within the hull of the ship mechanically raises and lowers the platform using wire ropes and sheaves. Malfunction of the mechanized components of the platform interferes with activities and operations on-board the ship.

SUMMARY

The application discloses a lift assembly configured to raise and lower a platform. Embodiments of the lift assembly have application for an elevator platform of the type described in the Background. As described herein, the lift assembly uses mechanized trolleys to raise and lower the platform. In the embodiments described, the trolleys include a drive portion and a lift portion movable along a track of a support frame or structure. Wire ropes are connected to the lift portion to raise and lower the platform via movement of the lift portion along the track of the support frame or structure. The lift portion is separable from the drive portion and is moved along the track via mechanized movement of the drive portion, for example, via a drive motor.

In an embodiment shown, pairs of trolleys are used to raise and lower the platform. As disclosed lift portions of the pairs of trolleys are connected via tensioned wires or lines to coordinate lift operations for the pairs of trolleys. In the event of failure of the mechanized drives of one trolley, the lift portion of that trolley moves via movement of the lift portion of the companion trolley through the tensioned wires or lines connecting the lift portions of the pair of trolleys. In an embodiment shown, the lift assembly includes four trolleys (or two pairs of trolleys) connected to the platform through wire ropes hitched to the platform. To provide redundancy and to help equalize loads carried by the platform, each trolley includes wire ropes hitched to the platform at multiple hitch points.

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that address shortcomings noted in the Background.

DETAILED DESCRIPTION OF ILLUSTRATIVE EMBODIMENTS

Figure 1:
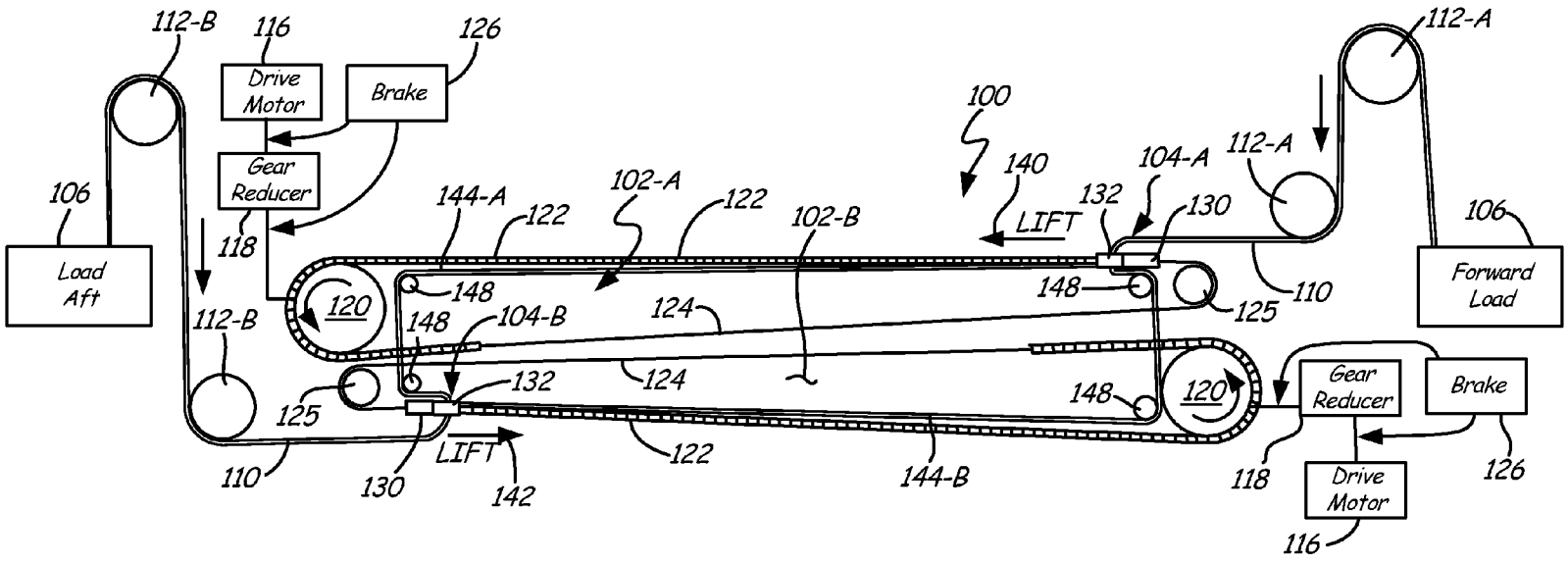
FIGS. 1-2 schematically illustrate an embodiment of a lift system including a pair of trolleys to lift a load or platform.
Figure 2:
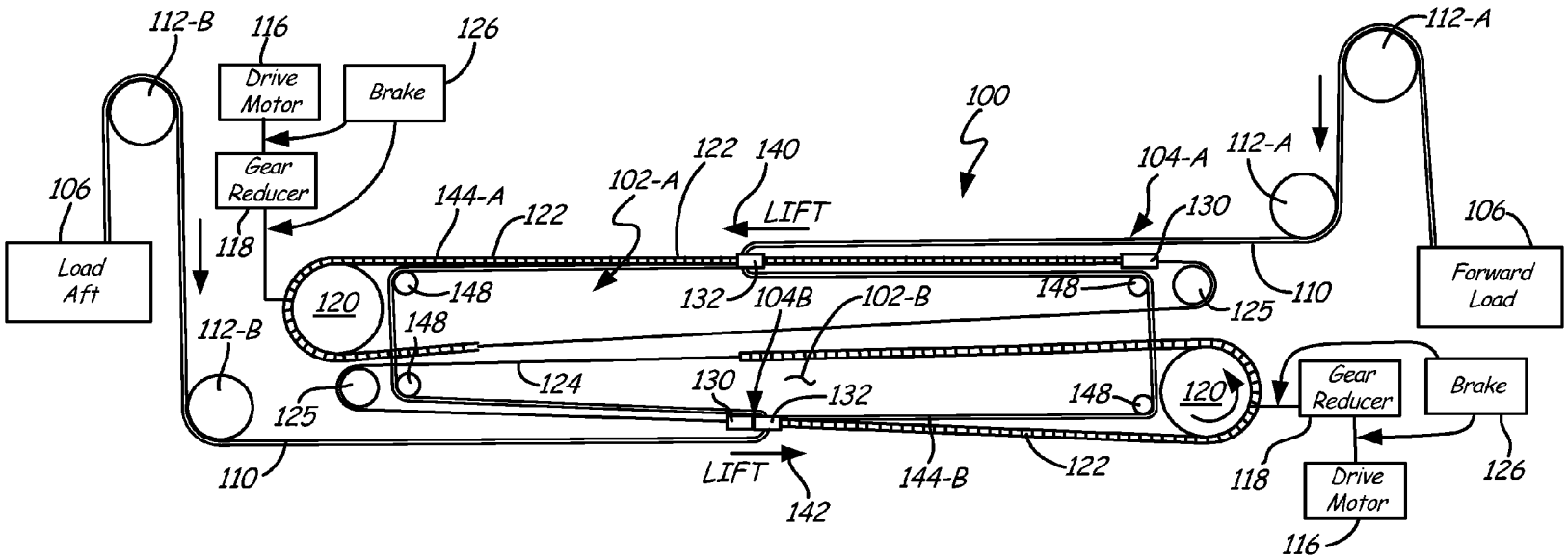

FIGS. 1-2 illustrate an embodiment of a lift system 100 including one or more trolleys operable via mechanized drive components. In the illustrated embodiment, the lift system 100 includes lift assemblies 102A, 102B having split trolleys 104A, 104B operable to raise and lower a load or platform 106 (see also FIG. 3). In the illustrated embodiment, the lift assemblies 102A, 102B are connected to the load or platform at forward and aft positions to raise and lower the load or platform 106. Illustratively the forward and aft positions correspond to opposed ends of a deck or elevator platform on a ship or aircraft carrier.

As shown, the lift assemblies 102A, 102B include mechanized drive assemblies that move the split trolleys 104A, 104B along a lift stroke to lift the load or platform 106. The trolleys 104A, 104B are connected to the load 106 through wire ropes 110. In the illustrated embodiment, a plurality of wire ropes 110 connect the first trolley 104A to the load 106 at a first or forward hitch point and wire ropes 110 connect the second trolley 104B to the load or platform 106 at a second or aft hitch point of the platform 106 spaced from the first hitch point. The wire ropes 110 connected to the first trolley 104A and the second trolley 104B are wound around sheaves 112A, 112B to guide the wire ropes 110 as the wire ropes 110 are pulled or extended to raise the load or platform 106. In the illustrated embodiment, the first and second hitch points correspond to forward and aft ends of an elevator platform as previously described.

Movement of the trolleys 104A, 104B along the lift stroke raises the load or platform 106. As previously disclosed, the trolleys 104A, 104B are moved along the lift stroke via mechanized drive assemblies. In the embodiment shown, the drive assemblies include a drive motor 116 and a gear assembly or reducer 118. Illustratively the drive motor 116 is an electric, pneumatic and/or hydraulic motor. Output from the drive motor 116 and/or gear assembly 118 is used to rotate a drive mechanism or sprocket 120 which engages a drive chain 122 coupled to the split trolleys 104A, 104B. Drive chains 122 are coupled to the trolleys 104A, 104B and are wound about the drive sprockets 120 so that rotation of the drive sprockets 120 moves the drive chains 122 and trolleys 104A, 104B to raise the load or platform 106. It is noted that the pitch diameter of the sprocket 120 should be as small as possible to reduce the amount of torque needed for operation, and hence, the torque capability of the gear reducer 118.

As shown in the illustrated embodiment, a chain or wire rope 124 connects an end of the drive chain 122 to the trolleys 104A, 104B. The chain 124 is wound about sheave 125 to form a continuous drive loop in cooperation with the drive chain 122. In the illustrated embodiment, chain 124 is a lighter weight chain than drive chain 122. In another embodiment a cable or other flexible member connects to the end of the drive chain 122 and to trolleys 104A, 104B to form the continuous drive loop.

In the embodiment shown, the drive assembly includes a brake 126 to hold the load in a raised position. Brake 126 operates to inhibit operation of the drive motor 116 or gear assembly 118 to brake or prohibit movement of the trolleys 104A, 104B. Illustratively, the brake 126 can include a caliper, drum or disc brake arrangement and application is not limited to a particular brake embodiment or a brake operable through the drive assembly as can be appreciated by those skilled in the art. In an illustrated embodiment, brakes 126 are configured to operate in a fail safe manner (for example, where the calipers are held back in a non-braking position by a hydraulic, pneumatic or electrical device and are moved to a braking position by a spring) so as to actively hold the platform 106 in a stable position when the power to the motors 116 is off or lost.

In the embodiment shown, the split trolleys 104A, 104B include a drive portion 130 and a lift portion 132. The trolley drive portion 130 is connected to the drive chain 122 and the wire ropes 110 are connected to the lift portion 132. Movement of the drive chain 122 moves the drive portion 130 of the trolleys 104A, 104B along the lift stroke. The lift portion 132 is in front of the drive portion 130 (with respect to movement during the lift stroke) so that movement of the drive portion 130 engages the lift portion 132 and pushes the lift portion 132 along the lift stroke. Movement of the lift portion 132 of the trolley pulls the wire ropes 110 in the direction of the lift stroke to raise the load or platform 106.

In the illustrated embodiment, the lift assembly 102A moves the split trolley 104A in a first or aft direction as illustrated by arrow 140 to raise a forward portion of the load 106 and the lift assembly 102B moves the split trolley 104B in a second or forward direction opposite to the first direction as illustrated by arrow 142 to raise an aft portion of the load or platform 106. In the illustrated embodiment lift assemblies 102A, 102B and trolleys 104A, 104B form a pair of trolleys to provide a compact design. In the illustrated embodiment, the trolleys 104A and 104B are arranged in a stacked manner so that the first or forward lift assembly 104A is elevated above the second or aft lift assembly 102B although application is not limited to the particular stacked arrangement shown. For example the aft lift assembly 104B could be elevated above the forward lift assembly 102A in another embodiment.

In the embodiment shown, lift portions 132 of trolleys 104A, 104B are connected through one or more tensioned trolley lines to interconnect the trolleys 104A, 104B to provide synchronized movement of the trolleys 104A, 104B in the event of failure the drive components or mechanisms of one of the lift assemblies 102A, 102B. In particular, in the embodiment shown, the one or more tensioned trolley lines includes a first trolley line 144A coupled to a front end of the lift portion 132 of trolley 104A and a back end of the lift portion 132 of trolley 104B and a second trolley line 144B coupled to the front end of lift portion 132 of trolley 104B and a back end of lift portion 132 trolley 104A to form a continuous loop of trolley lines 144A and 144B.

Thus, as shown, trolley 104A is interconnected to trolley 104B through line 144A and trolley 104B is interconnected to back trolley 104A through line 144B so that trolley 104A and trolley 104B synchronously move along the lift stroke. As shown, the first and second trolley lines 144A, 144B are wound about sheaves or pulleys 148 to form the continuous loop interconnecting the lift portions 132 of the trolleys 104A, 104B As comparatively illustrated in FIGS. 1-2, if the drive portion of one of the trolleys 104A, 104B is idled or is inoperable, the lift portion 132 will move separately from the drive portion 130 of the idled trolley to raise the load 106 in cooperation with lift portion 132 of the other trolley 104A or 104B. For example, in the illustration shown in FIG. 2, drive portion of trolley 104A is idled and movement of lift portion 132 of trolley 104B pulls the lift portion 132 trolley 104A along the lift stroke through the trolley line 144A connection of the lift portion 132 of trolley 104A to the lift portion 132 of trolley 104B. Thus, in the event of failure of one or more of the drive components of one of the lift assemblies 104A or 104B, the trolley lines 144A or 144B pulls the lift portion 132 of the idled trolley to take the slack out of the wire ropes 110 connected to the idled trolley so that the slack in the unloaded wire ropes 110 will be taken up by the driven trolley 104A or 104B.

Figure 3:
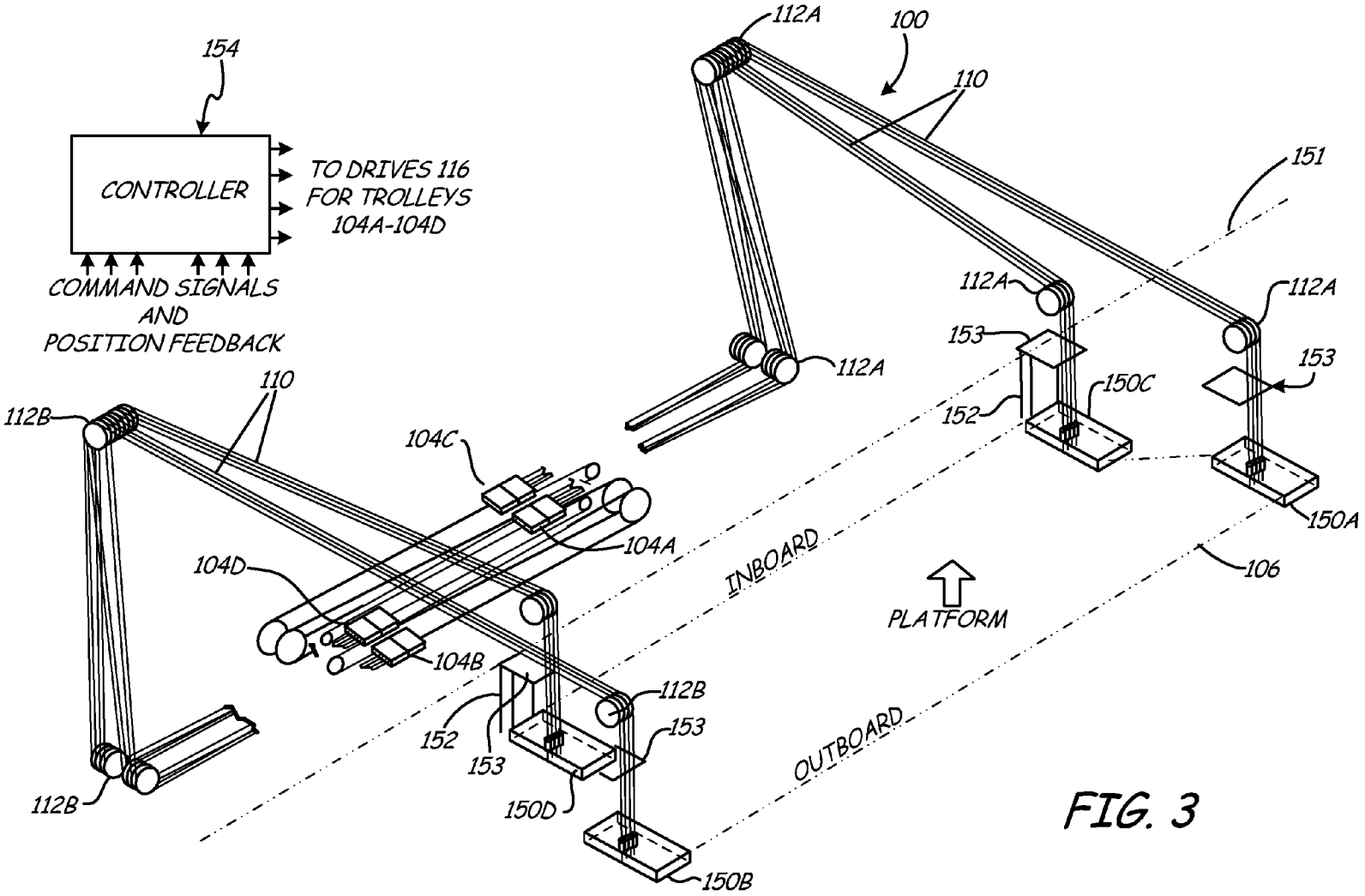
FIG. 3 illustrates an embodiment of a lift system for a platform including multiple pairs of trolleys operable to raise and lower wire ropes coupled to the platform at multiple hitch points.

FIG. 3 illustrates a lift system for an elevator platform 106 (shown in phantom) onboard a ship or aircraft carrier. As shown, the lift system includes multiple pairs of trolleys 104A-104B and 104C-104D configured to raise and lower the elevator platform 106. In the illustrated embodiment, the wire ropes 110 connected to the pairs of trolleys 104A-104B and 104C-104D are hitched to the platform at four hitch points 150A, 150B, 150C and 150D. The lift components and trolleys 104A-104D of the elevator platform are supported internally on the aircraft carrier as denoted by dotted line 151.

Sheaves 112A and 112B located on the aircraft carrier at various locations guide the wire ropes 110 between trolleys 104A-104D and the platform 106. Guide rails 152 are provided along an edge of the carrier or ship to guide the inboard side of the platform 106 hitched to the wire ropes 110 of the lift assembly at hitch points 150C and 150D. As shown, an outboard edge of the platform 106 hitched to the wire ropes 110 of the lift assembly at hitch points 150A and 150B is unguided, and is supported by the wire ropes 110 to raise and lower the platform 106. Operation of the trolleys 104A-104D raises the platform 106 to the flight or other deck of the ship or aircraft carrier. In the embodiment illustrated, the trolleys 104A-104D move along the lift stroke to raise the platform until the platform 106 contacts hard stops 153 proximate to the flight deck or other location.

In operation, the loads carried by the wire ropes 110 for each of the hitch points 150A-150D are not all the same. For example in an illustrated embodiment, wire rope loads for the outboard hitch points 150A and 150B are typically greater than the loads carried by the wire ropes 110 for inboard hitch points 150C and 150D. In order to balance the loads carried by each of the trolleys 104A-104D, each trolley 104A-104D is connected to one inboard hitch point 150C or 150D as well as to one outboard hitch point 150A or 150B.

In the embodiment illustrated, there are four wire ropes 110 connected to each hitch point 150A-150D and four wire ropes 110 connected to each trolley 104A-104D. For each hitch point 150A-150D, two wire ropes are connected to a first trolley, while the remaining two wire ropes are connected to another trolley. In the embodiment shown; wires 110 from trolley 104A are connected to hitch points 150A and 150C; wires from trolley 104B are connected to hitch points 150B and 150D; wires 110 from trolley 104C are connected to hitch points 150C and 150A; and wires from trolley 104D are connected to hitch points 150D and 150B. It should be appreciated that application is limited to the embodiments described where two wire ropes are connected to each trolley 104A-104D and corresponding hitch points 150A-150D and that any number of wire ropes 110 or arrangements can be used to connect trolleys 104A-104D to hitch points 150A-150D on the platform 106.

In the embodiment shown, each trolley 104A-104D is connected to two hitch points that are on the same aft end or forward end of the ship or platform 106. In an alternative embodiment, each trolley 104A-104D can be connected to inboard and outboard hitch points that are diagonally opposed to each other. Other hitching arrangements can be employed as will be appreciated by those skilled in the art. It should be noted that not all the components of FIGS. 1 and 2 are illustrated in FIG. 3 such as trolley lines 144A and 144B.

As shown in FIG. 3, a controller 154 is programmed to move the trolleys 104A-104D to the lifted position and tension the wire ropes 110 so the platform 106 is held tightly against the hard stops 153 so that the platform 106 does not move as it is loaded or unloaded. The controller 154 provides signals to each of the drives for trolleys 104A-104D and brakes 126 and receives command signals as well as position indications from sensors for the platform 106, the lift assembly, and/or drive motors. Each of the motors 116 for the trolleys 104A-104D can comprise variable frequency motors that each have internal resolvers (not shown) that can be used to indicate the position of the platform 106, and can be used by the controller 154 during both lifting as well as lowering of the platform to synchronize operation of the drives 116 for each of the trolleys 104A-104B.

Figure 4:
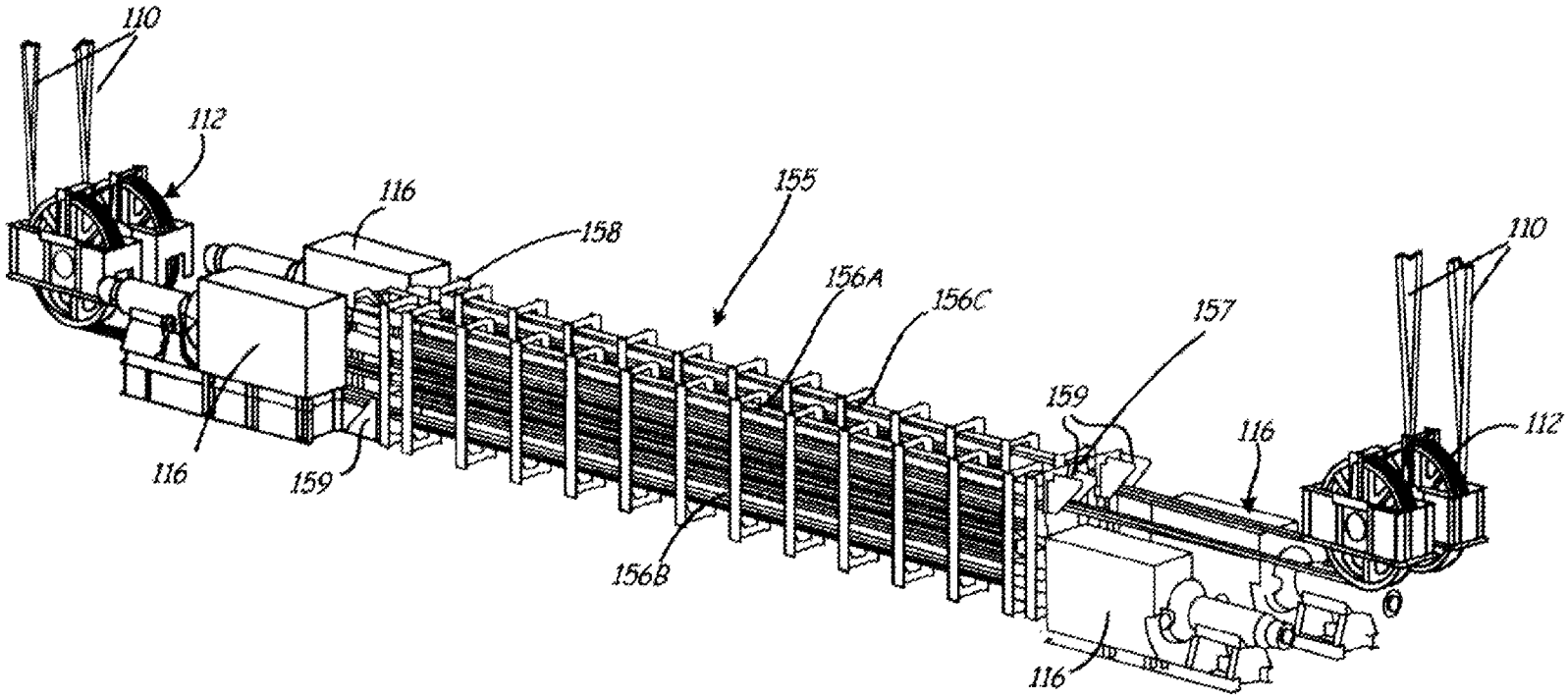
FIG. 4 is a perspective illustration of a frame structure for a lift system including multiple pairs of trolleys to raise and lower a load or platform as illustrated in FIG. 3.

FIG. 4 illustrates a support structure 155 for multiple pairs of trolleys 104A-104B and 104C-104D. As shown, the structure 155 includes upper and lower tracks 156A and 156B and adjacent upper and lower tracks 156C and 156D (not visible in FIG. 4). Each of the upper and lower tracks 156A-156B or 156C-156D includes a pair of trolleys 104A-104B or 104C-104D that are hitched to forward and aft positions of the load or platform 106 via wire ropes 110. Tracks are formed along guide rails of the structure 155. The frame structure 155 includes a forward end 157 and aft end 158. As shown, the tracks or structure includes stop contacts 159 to provide a hard or mechanical stop for the platform 106 in a lowermost position. In the illustrated embodiment, upper trolleys 104A, 104C are biased towards contact 159 at the forward end 157 of the frame structure 155 under the weight of the load 106 and lower trolleys 104B, 104D are biased towards the contact 159 at the aft end 158 of the frame structure 155 under the weight of the load or platform 106.

Figure 5:
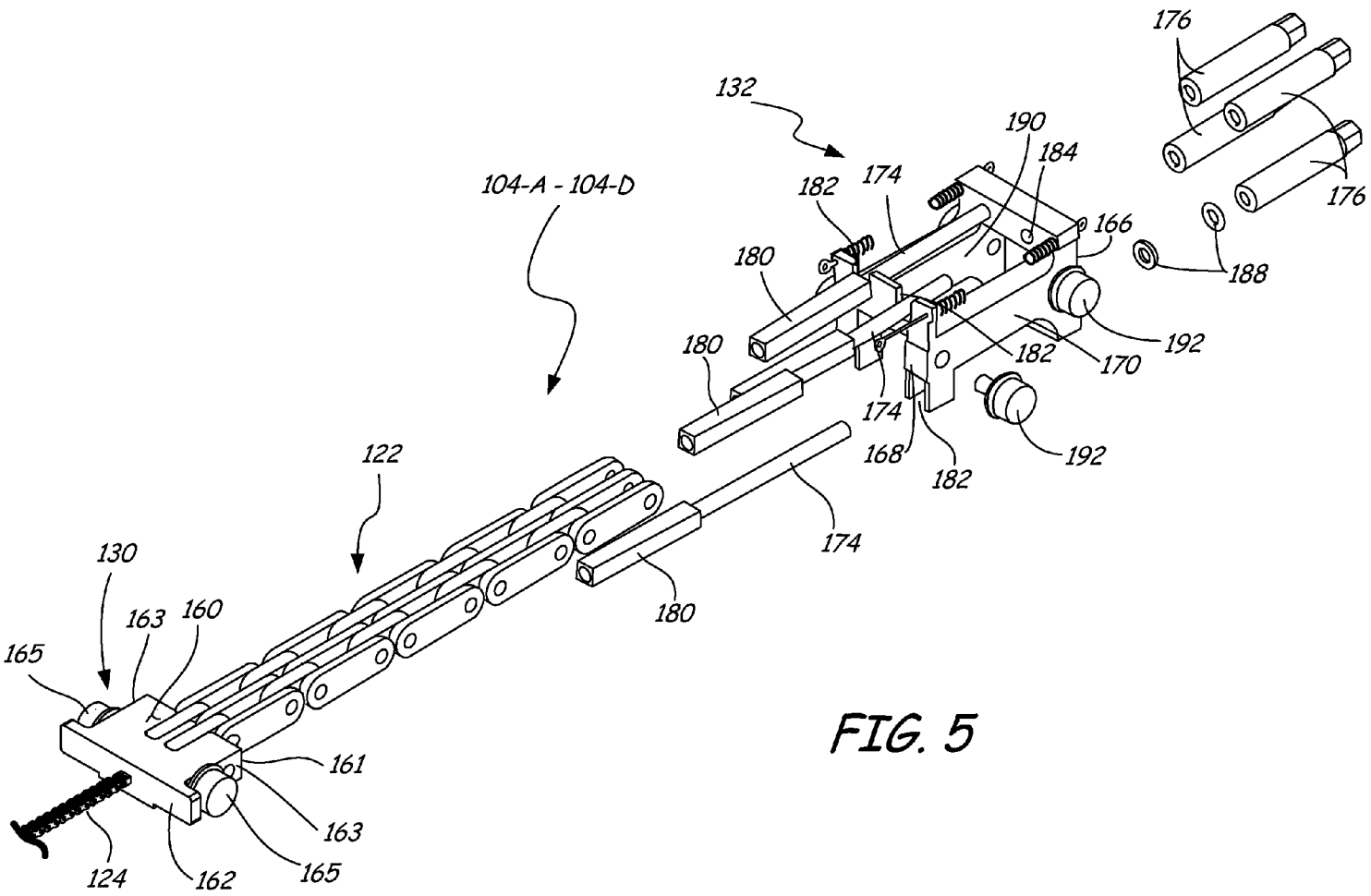
FIG. 5 is an exploded view of an embodiment of a split trolley for operation with the lift systems illustrated in FIGS. 1-4.
Figure 6:
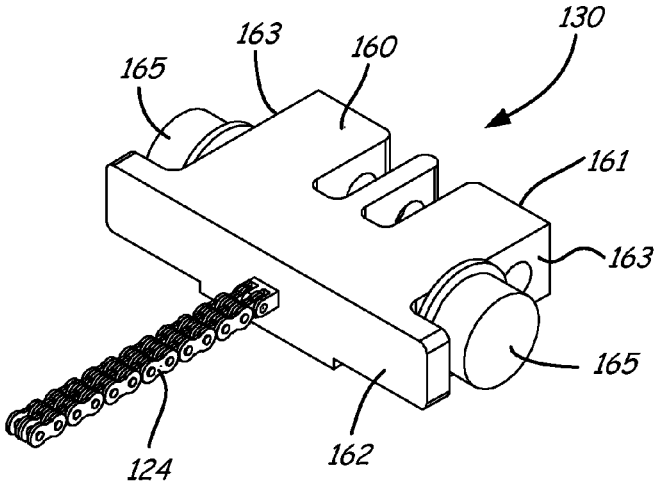
FIG. 6 illustrates an embodiment of a drive portion of the split trolley illustrated in FIG. 5.

FIG. 5 is a perspective illustration of an embodiment of split trolley for trolleys 104A-104D. The split trolley includes the separable drive and lift portions 130, 132. As shown in FIGS. 5-6, the drive portion 130 of the trolley has a body 160 including a front end 161, a rear end 162 and opposed sides 163. Drive chain 122 is connected to the front end 161 of the drive portion 130 to move the drive portion along the lift stroke. Links of the drive chain 122 are connected to the front end 161 of the drive portion 130 via a fastener (not shown). Chain 124 is connected to the rear end 162 of the drive portion 130 of the trolley to form the continuous drive loop as previously described. Rollers 165 are connected to the opposed sides 163 of the body of the drive portion 130 to allow the drive portion 130 to move along the tracks of the support structure 155 shown in FIG. 4.

As shown in FIGS. 5-8, the lift portion 132 of the trolleys 104A-104D includes a body having a forward end 166, a rear end 168 and opposed sides 170. As previously described, the wire ropes 110 are coupled the lift portion 132 of the trolley to raise the load 106 via movement of the lift portion 132 of trolley along the lift stroke. In the illustrated embodiment, four wire ropes 110 are connected to the lift portion 132 of each trolley. The wire ropes 110 include threaded fittings 172 (illustrated in FIGS. 7-8). The threaded fittings 172 are coupled to a connector rod 174, which is coupled to the body of the lift portion 132 via nuts 176.

Figure 7:
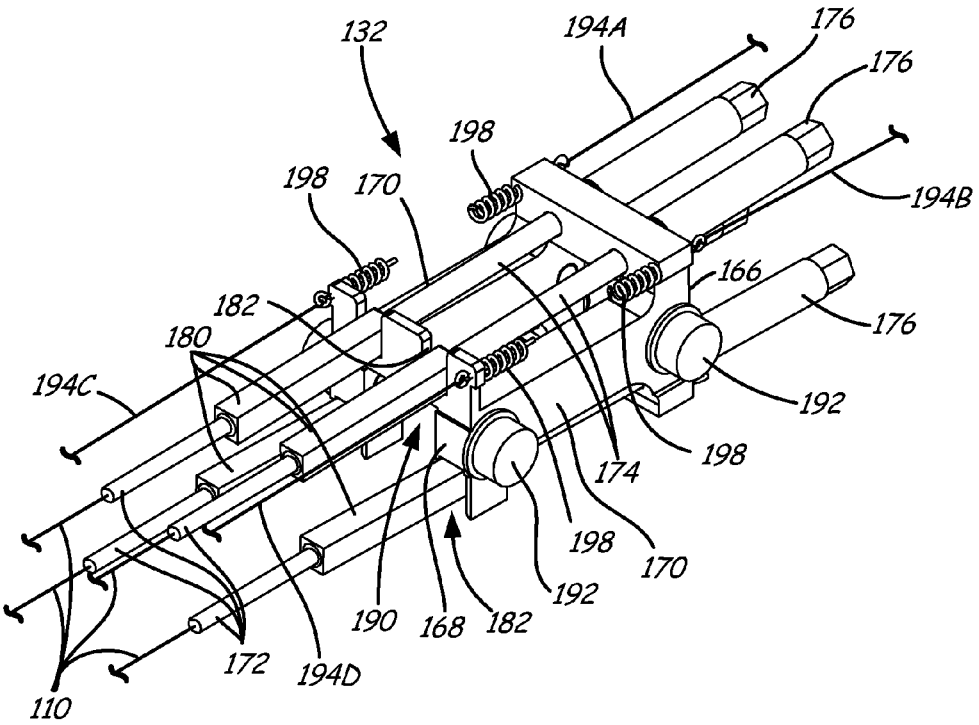
FIG. 7 is a perspective illustration of a lift portion of the split trolley illustrated in FIG. 5.
Figure 8:
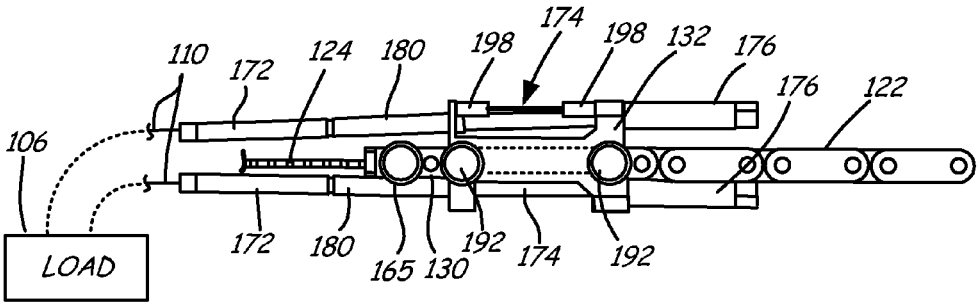
FIG. 8 is a side elevational view of an embodiment of the split trolley illustrated in FIG. 5.

As shown, the threaded fittings 172 are connected to the connector rods 174 through studs 180. As shown, the studs 180 are generally rectangular shaped and are supported between legs of "U" shaped brackets 182 on the body of the lift portion 132 to restrict rotation of the wire ropes 110. As illustrated in FIG. 7, the connector rods 174 extend through apertures 184 of the body. Spherical washers 188 (shown in FIG. 5) are disposed between the nuts 176 and connector rods 174. Nuts 176 are tightened to displace the connector rods 174 within the apertures 184 to tension the wire ropes 110. Tightening of each nut 176 causes tension forces in the wire ropes 110 to be reacted through the beveled washer 188. Alternatively connector rods can be threadably connected to portion 132 of trolley 104A-104D directly.

As shown in FIG. 5, the body of the lift portion 132 includes a passageway 190 extending between the forward and rear ends 166, 168 of the lift portion 132. The drive chain 122 extends from the drive portion 130 of the trolley through the passageway 190 to form the drive loop with chain 124. In the illustrated embodiment, rollers 192 are connected to the opposed sides 170 of the body of the lift portion 132 at the forward and rear ends to support the lift portion along the tracks of the support structure 155 as illustrated in FIG. 4.

Figure 9:
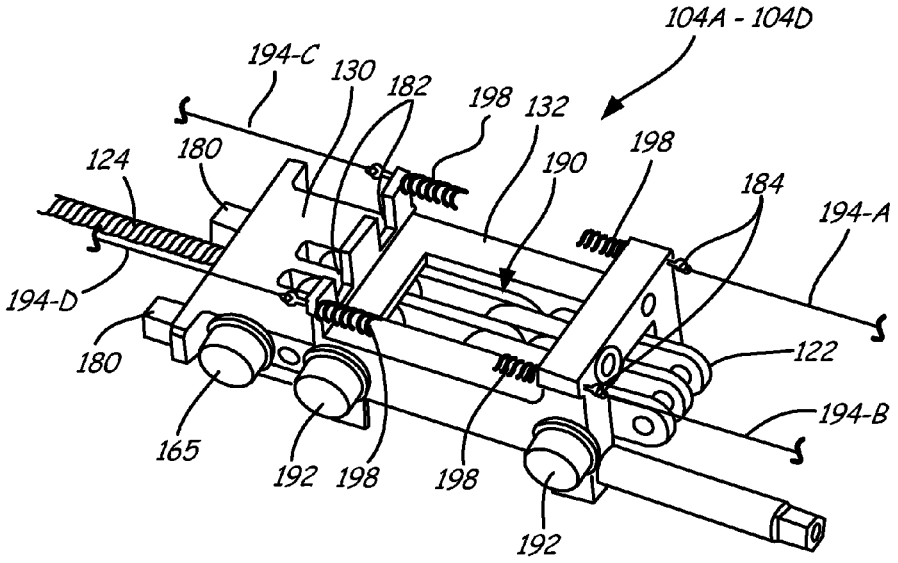
FIGS. 9-10 comparatively illustrate separation of the lift portion of the split trolley from the drive portion of the split trolley via operation of tensioned wires.
Figure 10:
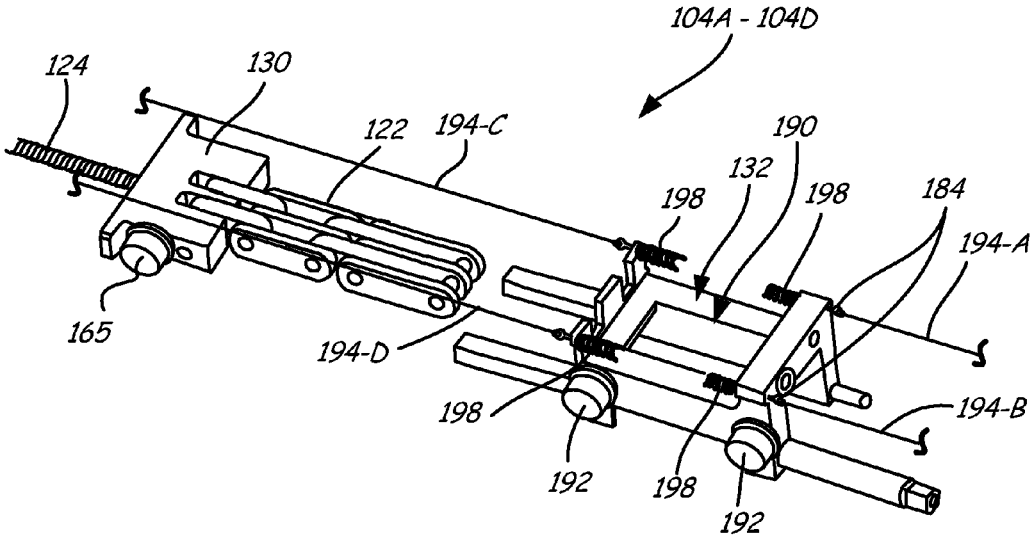

As previously described, trolley lines 144A, 144B are connected to the forward and rear ends of the lift portions 132 to interconnect pairs of trolleys 104A-104B and 104C-104D. In the illustrated embodiment, the trolley lines 144A, 144B includes two tensioned wires 194A, 194B connected to the forward end of the lift portion 132 and two tension wires 194C, 194D connected to the rear end of the lift portion 132 as shown in FIGS. 9-10. The tensioned wires 194A, 194B, 194C, 194D are connected to the lift portion 132 for example through a fastener element such as a hook or other fastener.

As shown, the tensioned wires 194A, 194B, 194C, 194D are connected to upright portions or stanchions on the forward and read ends of the lift portion 132 and are tensioned through springs 198 which supply a bias force to tension the wires 194A, 194B, 194C, 194D connected to the lift portion 132. In the embodiment shown, tension wires 194A, 194B, 192C, 192D are connected to an upper body portion of the lift portion 132 and in illustrative embodiments, additional tension wires can be connected to a lower body portion of the lift portion 132 and thus any number of tension wires can be used to interconnect the trolleys 104A-104B and 104C-104D.

As comparatively shown in FIGS. 1-2, movement of the drive chain 122 via operation of the drive assembly moves the drive portion 130 of the trolleys 104A, 104B along the lift stroke. As shown, a front surface of drive portion 130 abuts a rear end of the lift portion 132 of the trolleys 104A-104B and 104C-104D to push the lift portion 132 of the trolleys 104A-104B and 104C-104D along the lift stroke to raise the load or platform 106. As previously described, the lift portion is connected to the load 106 through the wire ropes 110. The weight of the load 106 biases the lift portion 132 downwardly. The downward force imparted through the lift portion 132 biases the drive portion 130 downwardly to lower the load 106 from the raised position to a lowered position.

As previously described with respect to FIGS. 1-2 if one of the drive mechanisms or assemblies for split trolleys 104A-104D fails, the trolley lines or wires 194A, 194B, 194C, 194D apply tension to the lift portion 132 of the failed trolley. The applied tension separates the lift portion 132 from the idled drive portion 130 and moves the lift portion 132 in cooperation with the lift portion 132 of the other split trolley as shown in FIG. 2 and as previously described. As previously described, the drive chain 122 extends through the passageway 190 in the body of the lift portion 132. When the lift portion 132 of the trolley 104A or 104B separates from the drive portion 130, the lift portion 132 slides along or over the drive chain 122 extending through the passageway 190 to move the lift portion 132 of the trolley 104A or 104B along the lift stroke to raise the load or platform 106 and take the slack out of the wire ropes 110 coupled to the lift portion 132 of the idled trolley.

Figure 11:
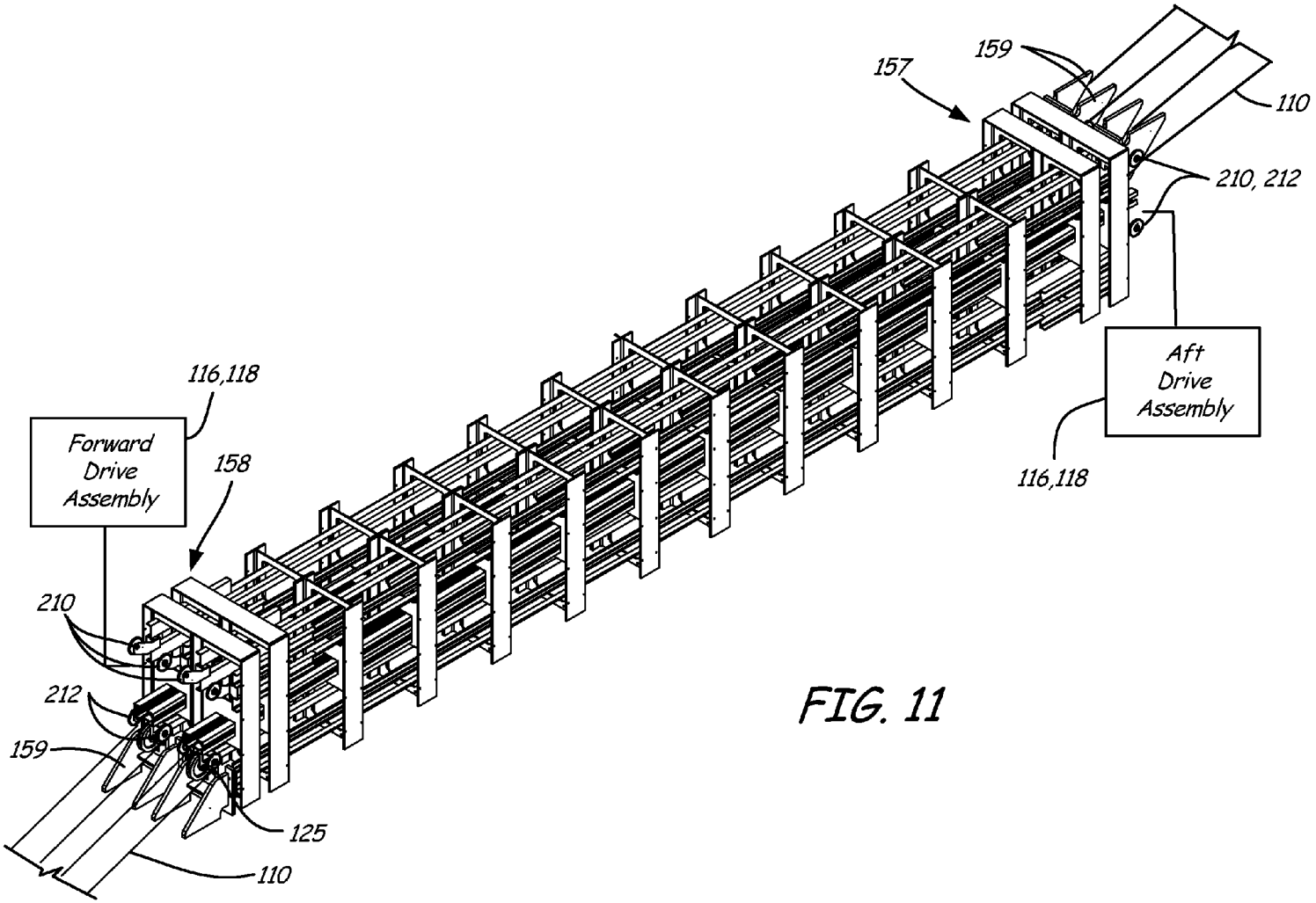
FIG. 11 is a perspective illustration of the frame structure configured to support multiple pairs of trolleys of a lift system.

For example, trolley 104A is interconnected to trolley 104B through line 144A (or tensioned wires 194A-194D) so that if drive assembly for trolley 104A is disabled, trolley 104A is pulled along the lift stroke via trolley 104B through trolley line 144A. Trolley 104B is interconnected to trolley 104A through line 144B so that if the drive assembly for trolley 104B is disabled or not operable, trolley 104B is pulled along the lift stroke via trolley 104A through trolley line 144B as described. As shown in FIG. 11, the frame structure 155 includes sheaves 125 to support the drive loop of the drive assemblies at the forward and aft ends 157, 158 of the frame structure 155 (only the aft end sheaves are shown). As shown, the forward and aft ends of the frame structure 155 include upper and lower pulleys 210, 212 to support the tensioned wires of the trolley lines 144A, 144B. As shown, each end 157, 158 includes multiple upper and lower pulleys 210, 212 to support the multiple tensioned wires connected to the forward and rear ends of the lift portions 132 of side by side trolleys 104A, 104C and 104B, 104D.

Figure 12:
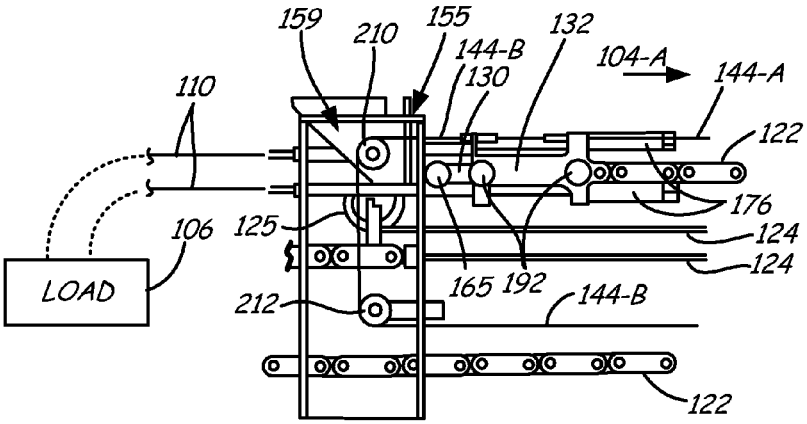
FIG. 12 is a detailed illustration of a split trolley and tensioned wires supported relative to the frame structure of FIG. 11.

FIG. 12 is a detailed illustration of the forward portion of the frame structure 155 as viewed in an outboard direction. As shown, illustrated trolley 104A is biased against forward stop contact 159. As shown, trolley line 144B (e.g. tensioned wires) from the lift portion 132 of trolley 104A are wound about pulleys 210, 212 to connect to trolley 104B (not shown). As previously described, trolley 104A is moved in the aft direction to raise load 106 as previous described. If desired, a mechanical hard stop can be provided on the support structure 155 to correspond to the uppermost position of the platform 106.

In the embodiments described above where the drive motors 116 comprise electric motors, a significant amount of generated energy is created when the platform 106 is lowered to its lowermost position. Specifically, during lowering, the trolleys 104A-104D move away from each respective drive 116 thereby causing the sprocket 120, gear reducer 118 and motors 116 to rotate in the reverse direction. In this condition, the motors 116 operate as generators. Although operating in this manner is beneficial in that it decreases the speed of which the platform 106 is lowered, the energy generated is quite substantial. In an illustrated embodiment, each motor is operably coupled to a resistive device for heat dissipation. Each of the resistive devices is submerged in an enclosure that can hold water or a flow of water, such as sea water. In view of the corrosive effects of sea water, the resistive devices are formed of a material to work in such an environment. For instance, the resistive devices can be formed of an alloy comprising copper and a nickel. Indeeco of St. Louis, Mo. sells resistive devices suitable for this purpose.

In the event of loss or other problems with the controller 154, manual operation of the drives for trolleys 104A-104D may be available. A manual override circuit would be hard wired to the drives to control the drives 116 to provide command signals. In the event of a controller problem, user selection of the manual override condition would command the drives to run off of a default set of parameters internal to the drives. These parameters would be set to operate the platform 106 in a simplified profile using only the required features important to controlling platform motion. Limit sensing and other non-critical feedback from the system would be ignored to ensure that platform motion can proceed.

Although illustrated and described with a chain and sprocket, the drive mechanism can utilize other flexible members operating in tension such as a belt, cogged belt, rope, wire rope, etc. If necessary, the sprocket can be replaced with a capstan depending on the flexible member used. Furthermore, other types of drive mechanisms besides a drive that pulls on a flexible member operating in tension can also be used. For instance, a linear actuator (electric, hydraulic and/or pneumatic) or screw drive can be used in lift assembly so as to control displacement of each of the trolleys 104A-104D. Although a particular frame structure and upper and lower arrangement or orientation of trolleys is shown, it should be understood however, application is not limited to the particular frame structure, arrangement or number of trolleys shown.

Although the subject matter has been described in language specific to structural features and/or methodological acts, it is to be understood that the subject matter defined in the appended claims is not necessarily limited to the specific features or acts described above as has been determined by the courts. Rather, the specific features and acts described above are disclosed as example forms of implementing the claims.

What is claimed:

1. An assembly comprising:

a drive having a drive member;

a track;

a trolley comprising:

a drive portion movable on the track and connected to the drive member to move the drive portion on the track; and a lift portion independently movable on the same track as the drive portion between the drive portion and the drive, the lift portion including one or more fittings configured to hold one or more wire ropes for raising and lowering a load hitched to the wire ropes, and wherein the drive portion and the lift portion are coupled such that a surface of the drive portion is configured to engage a surface of the lift portion in abutting contact and forcibly move the lift portion on the track only in a first direction of movement when the drive member drives the drive portion in a lift stroke, and wherein the abutting contact of drive portion with the lift portion does not forcibly move the lift portion for movement of the lift portion in a second direction that is opposite tote first direction;

a second trolley comprising a second drive portion and a second lift portion, the second drive portion and the second lift portion being coupled such that a surface of the drive portion is configured to engage a surface of the lift portion in abutting contact; and one or more tension lines connecting the lift portion with the second lift portion to form a continuous loop.

2. The assembly of claim 1 wherein the lift portion includes at least one fastener element to connect the lift portion to the one or more tension lines.

3. The assembly of claim 1 comprising a first tension line connecting the lift portion to the second lift portion and a second tension line connecting the second lift portion to the lift portion.

4. The assembly of claim 1 and further comprising a support structure, and wherein the track comprises two separate tracks on the support structure, and wherein the drive portion and the second drive portion are movable along different tracks of the two separate tracks and the one or more tension lines are wound about pulleys on the support structure.

5. The assembly of claim 4 wherein associated drive portions and lift portions include rollers on opposed sides of the associated drive portions and the lift portions and the rollers are configured to moveably support the associated drive portions and the lift portions along the different tracks of the support structure.

6. The assembly of claim 1 wherein the drive member comprises a drive chain coupled to the drive portion and engagable about the drive comprising a sprocket rotatable via a drive motor to move the drive portion to engage and move the lift portion along the lift stroke.

7. The assembly of claim 6 wherein the lift portion includes a passageway and the drive chain extends through the passageway of the lift portion.

8. The assembly of claim 6 wherein the drive chain is coupled to a first end of the drive portion and a cable is coupled to a second end of the drive portion and is connectable to the drive chain to form a continuous drive loop for the trolley.

9. A lift assembly comprising:

first and second trolleys movable along a track, the first trolley including a first drive portion movably guided in the track and a first lift portion separably movably guided in the track from the first drive portion, the second trolley including a second drive portion movably guided in the track and a second lift portion separably movably guided in the track from the second drive portion;

a first wire rope connected to the first lift portion and configured to be coupled to a load that is remote from the track;

a second wire rope connected to the second lift portion and configured to be coupled to the load that is remote from the track;

a first drive having a first drive member coupled to the first drive portion and configured to move the first drive portion of the first trolley to raise the load coupleable to the first lift portion of the first trolley through the first wire rope connected to the first lift portion of the first trolley, a second drive having a second drive member coupled to the second drive portion and configured to move the second drive portion of the second trolley to raise the load coupleable to the second lift portion of the second trolley through the second wire rope connected to the second lift portion of the second trolley, wherein each associated drive portion and lift portion has engaging, separable surfaces, wherein each drive is configured to move each respective drive portion to cause engagement of the surface of each respective drive portion with the surface of the associated lift portion to move the associated lift portion on the track in a first operating state to raise the load when each drive portion is displaced by each associated drive when the first and second drives are operated simultaneously; and one or more trolley lines, separate from the first and second wire ropes, the one or more trolley lines not being connected to the load and directly connecting the first and second lift portions of the first and second trolleys such that in a second operating state to raise the load where the first drive portion is unable to move on the track, both the first and second lift portions move on the track with movement of the second drive portion wherein the engaging surfaces of the first lift portion and the first drive portion separate and the second lift portion pulls the first lift portion with the one or more trolley lines.

10. The lift assembly of claim 9 comprising a first trolley line directly connecting the first lift portion of the first trolley to the second lift portion of the second trolley and a second trolley line directly connecting the second lift portion of the second trolley to the first lift portion of the first trolley.

11. The lift assembly of claim 10 wherein a first plurality of tensioned wires form the first trolley line and a second plurality of tensioned wires form the second trolley line.

12. The lift assembly of claim 10 wherein the first and second trolley lines form a continuous loop connecting the lift portions of the first and second trolleys.

13. The lift assembly of claim 9 wherein a first end of one of the lift portions of the first and second trolleys include two trolley lines connected to a second end of the lift portions of the other of the first and second trolleys.

14. The lift assembly of claim 9 wherein each drive comprises a drive motor configured to rotate a sprocket, and wherein each drive member comprises a drive chain movable via rotation of an associated sprocket to move each associated drive portion along a lift stroke to raise the load.

15. The lift assembly of claim 9 comprising:

third and fourth trolleys including third and fourth drive portions and third and fourth lift portions respectively, each of the first, second, third and fourth trolleys being coupled to at least two hitch points of a platform having at least four hitch points through the wire ropes connected to the lift portions of the first, second, third and fourth trolleys.

16. The lift assembly of claim 9 wherein the track comprises first and second tracks, the first drive portion and the first lift portion movable on the first track and the second drive portion and the second lift portion movable on the second track, the drive and lift portions of the first and second trolleys include rollers to movably support the first and second trolleys along the first and second tracks, respectively.

17. A method for moving a load, the method comprising:

providing a first trolley on a first track, the first trolley having a first drive portion and a first lift portion each independently movable on the first track, a first drive having a first drive member connected to the first drive portion, and a second trolley on a second track, the second trolley having a second drive portion and a second lift portion each independently movable on the second track, a second drive having a second drive member connected to the second drive portion, wherein the first drive portion is in abutting contact with the first lift portion where operation of the first drive causes the first drive portion to forcibly move the first lift portion along the first track in a first driven direction and wherein the abutting contact of first drive portion with the first lift portion does not forcibly move the first lift portion for movement of the first lift portion in a first track direction that is opposite to the first driven direction, wherein the second drive portion is in abutting contact with the second lift portion where operation of the second drive causes the second drive portion to forcibly move the second lift portion along the second track in a second driven direction and wherein the abutting contact of second drive portion with the second lift portion does not forcibly move the second lift portion for movement of the second lift portion in a second track direction that is opposite to the second driven direction and each lift portion being separately connected to the load with wire ropes and connected directly to each other with a line separate from the wire ropes;

in a first operating state to lift the load, the first drive and the second drive are operated at the same time to cause the first drive portion to forcibly drive the first lift portion in the first driven direction on the first track and the second drive portion to forcibly drive the second lift portion in the second driven direction on the second track; and in a second operating state to lift the load, with the second drive inoperative and the second drive member and the second drive portion stationary with respect to the second track, operating the first drive to forcibly drive the first lift portion in the first driven direction on the first track, and wherein the line pulls the second lift portion on the second track in the second driven direction.

18. The method of claim 17 and further comprising:

utilizing a chain for each drive member.

19. The method of claim 17 wherein when operating the first drive, the second lift portion moves between the second drive and the stationary second drive portion.

* * * * *